US007803032B2

(12) United States Patent
Yamaguchi et al.

(10) Patent No.: US 7,803,032 B2
(45) Date of Patent: Sep. 28, 2010

(54) REMOTE-CONTROL TOY AND EXTENSION UNIT

(75) Inventors: Takashi Yamaguchi, Tokyo (JP); Yasuhiro Kajihara, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 1251 days.

(21) Appl. No.: 10/542,528

(22) PCT Filed: Jan. 16, 2004

(86) PCT No.: PCT/JP2004/000308

§ 371 (c)(1),
(2), (4) Date: Oct. 28, 2005

(87) PCT Pub. No.: WO2004/064966

PCT Pub. Date: Aug. 5, 2004

(65) Prior Publication Data

US 2006/0128267 A1 Jun. 15, 2006

(30) Foreign Application Priority Data

Jan. 17, 2003 (JP) ..... 2003-045132

(51) Int. Cl.
*A63H 30/00* (2006.01)

(52) U.S. Cl. ..... 446/454; 446/433

(58) Field of Classification Search ..... None
See application file for complete search history.

(56) References Cited

U.S. PATENT DOCUMENTS 5,088,955 A * 2/1992 Ishimoto ..... 446/409
5,195,920 A 3/1993 Collier
7,072,792 B2 * 7/2006 Freifeld ..... 702/178
2003/0001051 A1 * 1/2003 Wolf et al. ..... 246/187 A

FOREIGN PATENT DOCUMENTS

| | | |
|---|---|---|
| DE | 20201453 | 6/2002 |
| EP | 0 446 881 A1 | 9/1991 |
| JP | 62-92894 A1 | 6/1987 |
| JP | 2001-243046 A | 9/2001 |

OTHER PUBLICATIONS

International Search Report for PCT/JP2004/000308 mailed on Apr. 13, 2004.

* cited by examiner

*Primary Examiner*—Ronald Laneau
*Assistant Examiner*—Tramar Harper
(74) *Attorney, Agent, or Firm*—Edwards Angell Palmer & Dodge LLP; Peter C. Schechter; Brian R. Landry

(57) ABSTRACT

A remote-control toy is provided that includes: a controller that transmits a control signal containing an operating instruction based on an operation instruction by a user; a driving device that is driven and controlled based on the control signal; and an extension unit that is capable of receiving the control signal. The extension unit includes: a unit main body and a signal processing device that can be detachably connected to the unit main body. In the unit main body, the received control signal is output to the signal processing device, and processing according to an instruction signal output from the signal processing device is performed. In the signal processing device, the contents of the operating instruction contained in the control signal that is output from the unit main body are discriminated, and an instruction signal based on the operation corresponding to the contents is output to the unit main body.

3 Claims, 3 Drawing Sheets

REMOTE-CONTROL TOY AND EXTENSION UNIT

CROSS-REFERENCE TO PRIOR APPLICATION

This is a U.S. National Phase application under 35 U.S.C. §371 of International Patent Application No. PCT/JP2004/000308 filed Jan. 16, 2004 and claims the benefit of Japanese Patent Application No. 2003-045132, filed Jan. 17, 2003, both of which are incorporated by reference herein. The International Application was published in Japanese on Aug. 5, 2004 as WO 2004/064966 A1 under PCT Article 21(2).

TECHNICAL FIELD

The present invention relates to a remote-control toy that controls a movable body by transmitting a control signal from a controller to the movable body.

BACKGROUND ART

There have already been various remote-control toys that are driven by driving devices paired with controllers, based on control signals transmitted from the controllers. Each of the controllers contains control information as to the driving device with which the controller is paired. According to the control information, the running performance of the driving device such as the running direction or the running speed can be adjusted.

In such a conventional remote-control toy, however, each control signal is transmitted silently and invisibly from the controllers. As a result, a user can have only a poor realistic sensation in the playing. Even in a match-up game, the match progresses silently, and lacks excitement. To achieve a higher realistic sensation, it is preferable to prepare each different device for effects suitable for each different type of driving device. However, doing so causes the problems of placement locations and costs.

DISCLOSURE OF INVENTION

Therefore, the object of the present invention is to provide a remote-control toy that provides high realistic sensation and more excitement of playing by employing a general extension unit that performs processing suitable for the type of each driving device by one unit, based on an operation by a user.

The above mentioned problems are eliminated by a remote-control toy that includes: a controller that transmits a control signal containing an operating instruction based on an operation by a user; a driving device that is controlled to drive based on the control signal; and an extension unit that is capable of receiving the control signal. The extension unit includes a unit main body and a signal processing device that can be detachably connected to an external portion of the unit main body. The unit main body includes: a signal receiver that receives the control signal; a terminal portion that outputs the received control signal to the signal processing device; and a processor that performs processing based on an instruction signal that is output from the signal processing device. The signal processing device includes: a connecting portion that is connected to the terminal portion; a processing determining unit that discriminates the contents of the operating instruction contained in the control signal that is input through the connecting portion, and determines processing corresponding to the instruction contents; and an instruction signal output unit that produces the instruction signal based on the determined processing, and outputs the produced instruction signal to the connecting portion. The processor performs the determined processing based on the instruction signal that is input through the terminal portion.

With the remote-control toy of the present invention, the control signal that is transmitted from the controller to the driving device according to an operation by a user is received also by the extension unit. Like in the driving device, the instruction contents that are directed to the driving device and are contained in the control signal are decoded in the extension unit, and processing based on the instruction contents is performed. According to the present invention, the extension unit is configured with the unit main body and the signal processing device that is attachable to and detachable from the unit main body. In the unit main body, only the reception of the control signal and the processing are implemented, and the instruction contents directed to the driving device are discriminated and the processing corresponding to the instruction contents is determined by the signal processing device. Even if there are driving devices of several types, signal processing devices that can decode the instruction contents issued from controllers to the driving devices to be driven are connected to the unit main body, so that processing suitable for the type of each driving device can be determined in the signal processing device and can be implemented in the unit main body. Since the instruction contents are decoded in the detachable signal processing device, according to the type of the driving device to be operated, the signal processing device that can decode the control signal corresponding to the driving device, should be connected to the unit main body. Further, since the signal processing device is to be connected to an external portion of the unit main body, the attachment and detachment of the signal processing device can be easily carried out.

The operation determining unit may determine processing with respect to the sound corresponding to the instruction contents, and the signal output unit may output sound based on the instruction signal. Thus, the sound can be output from the extension unit as an audio effect suitable for the operation by the user.

The above described problems are also eliminated by an extension unit that is provided in a remote-control toy that has a controller that transmits a control signal containing an operating instruction according to an operation by a user, and a driving device that is controlled to drive based on the control signal. The extension unit is capable of receiving the control signal, and includes a unit main body and a signal processing device that can be detachably connected to an external portion of the unit main body. The unit main body includes: a signal receiver that receives the control signal; a terminal portion that outputs the received control signal to the signal processing device; and a processor that performs processing based on an instruction signal that is output from the signal processing device. The signal processing device includes: a connecting portion that is connected to the terminal portion; a processing determining unit that discriminates the contents of the operating instruction contained in the control signal that is input through the connecting portion, and determines processing corresponding to the instruction contents; and an instruction signal output unit that produces the instruction signal based on the determined processing, and outputs the produced instruction signal to the connecting portion. The processor performs the determined processing based on the instruction signal that is input through the terminal portion. The remote-control toy of claim 1 can be realized with this extension unit.

BEST MODE FOR CARRYING OUT THE INVENTION

Figure 1:
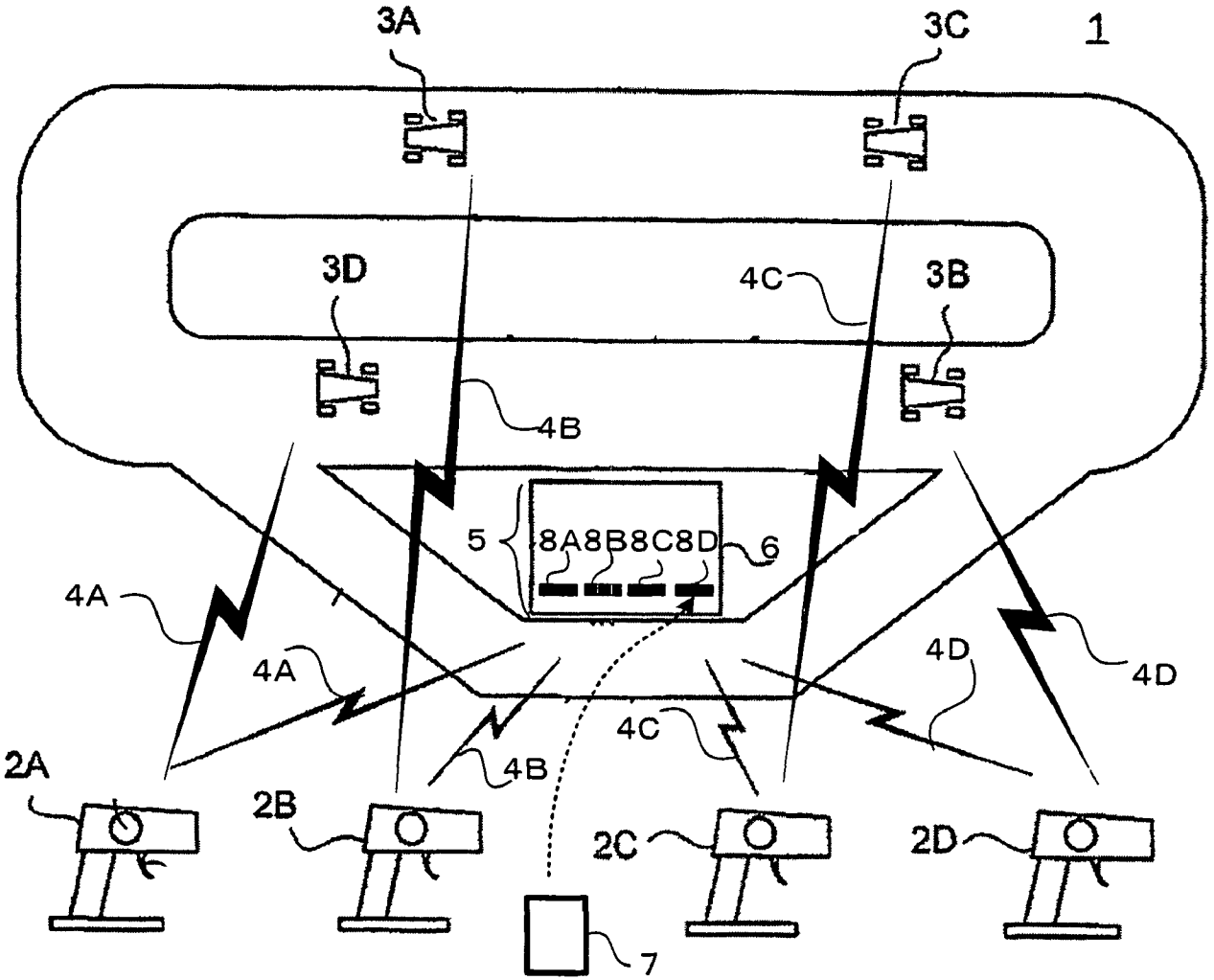
FIG. 1 shows an example of embodiments of the present invention.

FIG. 1 shows a remote-control toy 1 that is an example of embodiments of the present invention. In the remote-control toy 1, controllers 2A, 2B, 2C, and 2D are respectively paired with automobile models 3A, 3B, 3C, and 3D as driving devices. The controllers 2A, 2B, 2C, and 2D transmit control signals 4A, 4B, 4C, and 4D to the automobile models 3A, 3B, 3C, and 3D, respectively. An extension unit 5 is disposed at such a location as to be able to receive the control signals 4A, 4B, 4C, and 4D. Hereinafter, the controllers 2A to 2D will be referred to simply as the controller(s) 2, unless there is a need to distinguish them. Likewise, the automobile models 3A to 3D will be referred to simply as the automobile model(s) 3, unless there is a need to distinguish them. The control signals 4A to 4D will be referred to simply as the control signal(s) 4, unless there is a need to distinguish them.

In this embodiment, infrared rays are used as the means of transmitting the control signals 4 from the controllers 2. The automobile model 3 has the same ID number as the controller 2 paired with the automobile model 3. Controller 2 transmits the control signal 4, which contains the own ID number. If the automobile 3 receives the control signal 4 containing the same ID number as the ID number of itself, the automobile model 3 determines that the control signal 4 is directed to itself. Accordingly, the control signal 4 contains the ID number for identifying the automobile model 3 paired with and control information as an operation instruction from a user. Also, to avoid crosstalk, the controllers 2 adjust the transmission timing of one another. In this embodiment, the ID numbers 1 to 4 are prepared, so that up to four automobile models 3 can be driven at once. However, the number of ID numbers is not limited to four.

The extension unit 5 includes a unit main body 6 and card-like cartridges by vehicle 7 as signal processing devices. The unit main body 6 has slots 8A, 8B, 8C, and 8D to and from which the cartridge by vehicle 7 can be attached and detached. Hereinafter, the slots 8A to 8D will be referred to simply as the slot(s) 8, unless there is a need to distinguish them. The cartridge by vehicle 7 is inserted to the slots 8 so as to be mounted to the unit main body 6.

The cartridge by vehicle 7 corresponds to the automobile model 3 to be controlled one by one.

Each of the ID numbers is unique to each corresponding slot 8. For example, when the ID number "1" is allotted to the slot 8A, the ID number "2" is allotted to the slot 8B, the ID number "3" is allotted to the slot 8C, and the ID number "4" is allotted to the slot 8D, if the ID number of the automobile model 3A is "4", a cartridge by vehicle 7 to correspond to the automobile model 3A should be inserted to the slot 8D set as ID number "4". Each of the cartridges by vehicle 7 to correspond to the other automobile models 3 should be also inserted to the slot 8 of the same ID numbers as the corresponding automobile model 3.

In this embodiment, the slots 8 are formed at four locations, but the number of slots 8 may be varied in accordance with the number of remotely controllable automobile models 3 at the same time. Also, an ID number setting switch corresponding to each slot 8 may be provided in the unit main body 6, so that a user can set an ID number corresponding to each slot 8. In this embodiment, each cartridge by vehicle 7 is in the form of a card, and each slot 8 has such a shape that a card can be inserted thereto. However, the shapes of each cartridge by vehicle 7 and each corresponding slot 8 are not limited to the above, as long as they can be detachably connected to each other.

Figure 2A:
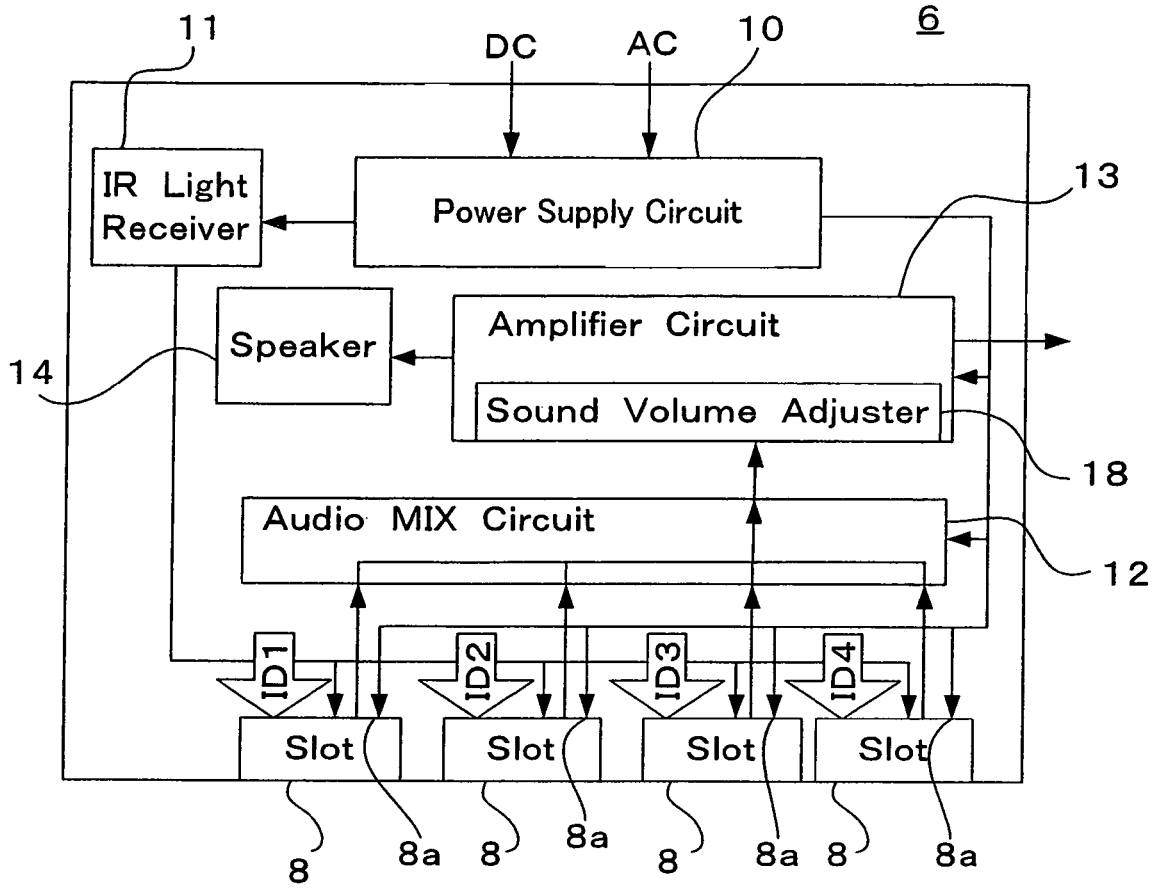
FIG. 2A is a functional block diagram of an extension unit.
Figure 2B:
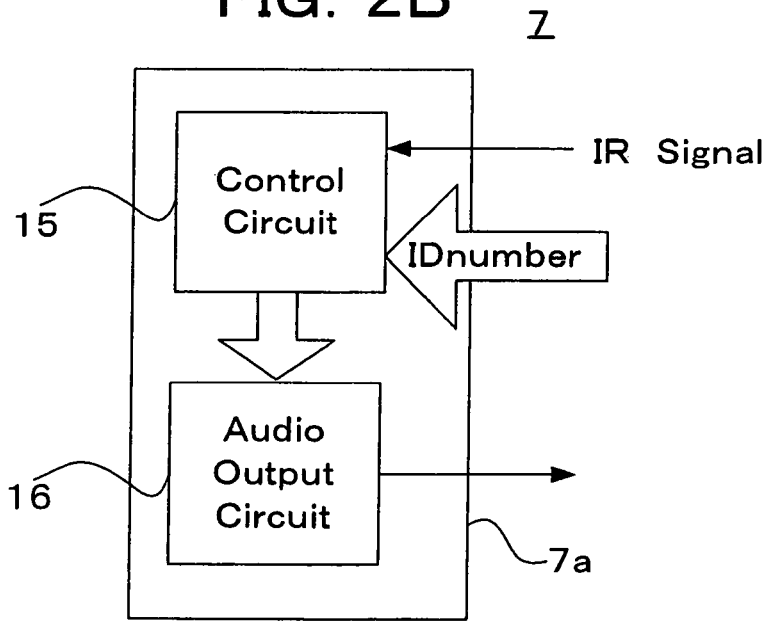
FIG. 2B is a functional block diagram of a cartridge by vehicle.

Referring now to FIG. 2, a case where sound is output as processing corresponding to an operation to the automobile model 3 is described with respect to each component in the unit main body 6 and cartridge by vehicle 7 respectively. FIG. 2A is a functional block diagram of the unit main body 6. FIG. 2B is a functional block diagram of the cartridge by vehicle 7.

As shown in FIG. 2A, the unit main body 6 includes: a power supply circuit 10 that supplies electricity to the unit main body 6 and the cartridges by vehicle 7, regardless of direct current or alternating current; an IR light receiver 11 as a signal receiver that receives the control signals 4 from the controllers 2; the slots 8 to each which the cartridge by vehicle 7 is inserted; an audio MIX circuit 12 as a processor that synthesizes output audio signals produced in each cartridge by vehicle 7; and an amplifier circuit 13 and a speaker 14 that output the synthesized sound. Each of the slots 8 has a terminal portion 8*a* that inputs and outputs signals to and from the corresponding cartridge by vehicle 7 mounted to the unit main body 6.

As shown in FIG. 2B, the cartridge by vehicle 7 includes a connecting portion 7*a* to be connected to the corresponding terminal portion 8*a*, a control unit 15 as a processing determining unit, and an audio output circuit 16 as an instruction signal output unit. The control unit 15 is configured as a computer that has a CPU and various peripheral circuits necessary for the operation of the CPU, such as a RAM and a ROM.

The processing of each component during the time in which the control signal 4 transmitted from the controller 2 is received, and the sound based on the control signal 4 is output is now described. Upon receipt of the control signal 4, the IR light receiver 11 transmits the control signal 4 to the slots 8. The control signal 4 is then sent from the terminal portion 8*a* to the control unit 15 via the connecting portion 7*a* of the cartridge by vehicle 7 mounted to the slot 8.

If the control signal 4 is discriminated to be directed to the corresponding automobile model 3, the control unit 15 decodes the control information contained in the control signal 4. If the ID number contained in the control signal 4 is the same as the ID number allotted to the mounted slot 8, the control signal 4 is discriminated to be directed to the corresponding automobile model 3. The decoding of the control information means to determine the instruction contents from a user by the same method as the method used in the driving device. When the driving device is a running model like the automobile model 3, the instruction contents include "acceleration", "deceleration", "curving", or the like. After the control information is decoded, a signal of an audio data producing instruction is output to the audio output circuit 16 to produce the sound corresponding to the instruction contents from the user. The audio output circuit 16 in turn produces an output audio signal according to the audio data producing instruct, and then outputs the output audio signal to the connecting portion 7*a*. The output audio signal is input to the audio MIX circuit 12 via the terminal portion 8*a*. Here, the type of sound source does not matter, and a FM sound source, a PCM sound source, or the like may be employed.

The audio MIX circuit 12 synthesizes the output audio signals transmitted from each terminal portion 8*a*. The synthesized output audio signals are adjusted by a sound volume adjuster 18 in the amplifier circuit 13, and is then output as sound from the speaker 14.

Figure 3:
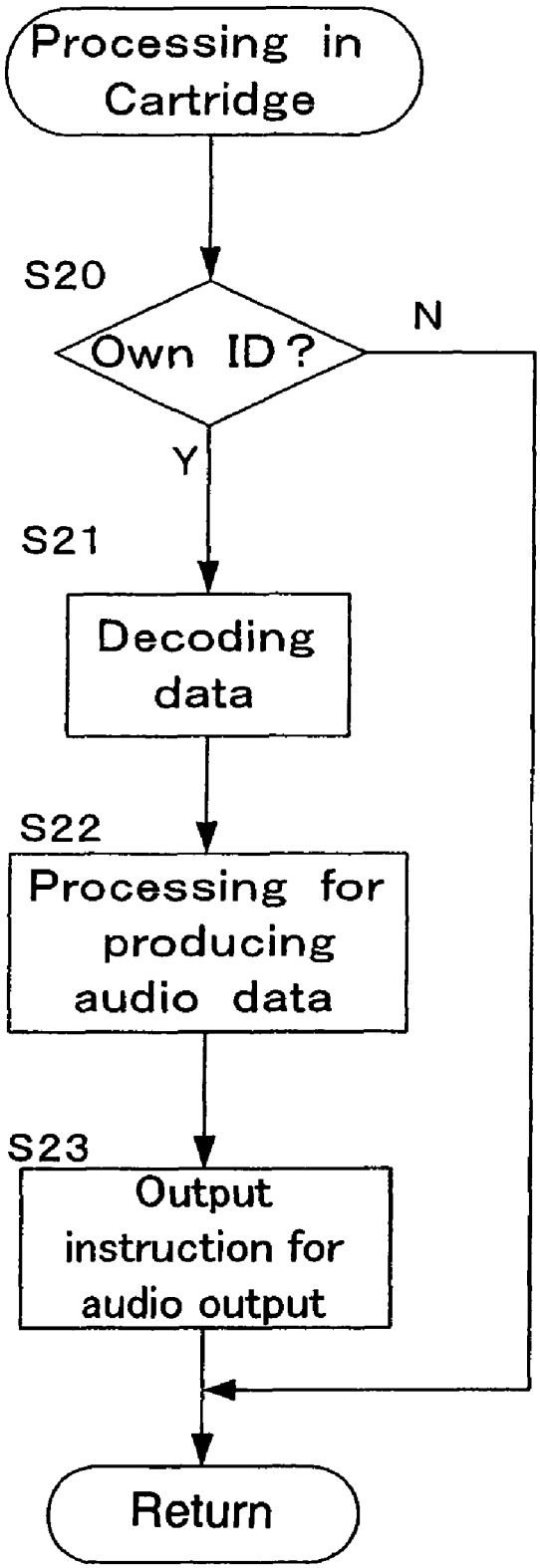
FIG. 3 is a flowchart of the processing to be performed by the control unit of each cartridge by vehicle.

Referring now to a flowchart of FIG. 3, the processing to be performed by the control unit 15 of each cartridge by vehicle 7 after the control signal 4 is input to the control unit 15 from the unit main body 6 from the unit main body 6 is described.

First, the transmitted control signal 4 is discriminated whether to contain the ID number of the slot 8 to which the cartridge by vehicle 7 is inserted (step S20). If the control signal 4 contains the ID number of the slot 8 to which the cartridge by vehicle 7 is inserted, the control signal 4 is discriminated to be directed to the corresponding automobile model 3, and the control contents in the control signal 4 are decoded (step S21). Based on the control contents, the operation of the automobile model 3 is discriminated, and an audio data producing instruction corresponding to the operation is produced (step S22). In accordance with the audio data producing instruction, an output audio signal is produced (step S23). The produced output audio signal is then output to the connecting portion 7*a*. If the control contents indicate "acceleration", for example, an output audio signal that represents a change in engine sound or squeaking sound of a tire caused with acceleration is produced, and is output to the audio MIX circuit 12 in the unit main body 6. Other audio data that can be produced by the control unit 15 include data representing the sound of a car whizzing past, the cheering of crowd, or the sound or a car crashing.

Meanwhile, if the control signal 4 transmitted in step S20 is discriminated not to contain the ID number of the slot 8 to which the corresponding cartridge by vehicle 7 is inserted, the control signal 4 is discriminated not to be directed to the corresponding automobile model 3, and any processing is not performed on the control signal 4.

The present invention is not limited to the above described embodiment, and various modifications may be made to it. For example, other than the sound output that is auditorily effective, a visually effective such as light or a predetermined image may be performed as processing corresponding to the operation instruction directed to the automobile model 3.

As for the driving devices 3, they are not limited to the automobile models 3, but may be combat vehicle models or animal models, as long as they can be controlled to drive by the controllers 2. In that case, the control unit 15 of each signal processing device 7 should be designed to be able to decode the control information for controlling the driving devices 3. In the case of a combat vehicle model, the sound to be output may be the sound of the caterpillar wheels or the sound of shooting or explosion. In the case of an animal model, the sound to be output may be the animal call suitable for each animal model or the sound of the footsteps suitable for each animal model.

The audio output circuits 16 may be prepared according to the various characteristics of the automobile models 3. For example, if the automobile models 3 have different displacements, the audio output circuits 16 should be prepared according to the various displacements. In this manner, an output audio signal representing the engine sound suitable for each displacement is produced in response to the same audio data producing instruction. Thus, sound effects suitable for the characteristics of each automobile model 3 can be output.

The output of the effect corresponding to each operation may not be performed at the same time as the operation by a user. For example, the predetermined data corresponding to the operation is stored in the control unit 15, and the signal for performing a predetermined processing may be output to the unit main body 6 in predetermined timing based on the predetermined data.

As described so far, according to the present invention, a remote-control toy that can provide higher realistic sensation and more excitement of playing can be produced by employing a general extension unit that performs processing suitable for various types of driving devices by one unit, based on operations by users.

The invention claimed is:

1. A remote-control toy comprising:

a controller for transmitting a control signal containing an operating instruction based on an operation by a user, the operating instruction including a device identifier;

a driving device for being controlled based on the control signal, the driving device corresponding to the device identifier; and an extension unit for receiving the control signal, the extension unit comprising:

a unit main body; and a signal processing device detachably connected to an external portion of the unit main body, the unit main body comprising:

a signal receiver for receiving the control signal;

a terminal portion for outputting the received control signal to the signal processing device, the terminal portion corresponding to the device identifier; and a processor for executing output processing based on an instruction signal that is output from the signal processing device, the signal processing device comprising:

a connecting portion that is connected to the terminal portion;

a processing determining unit for discriminating the contents of the operating instruction contained in the control signal that is input through the connecting portion, for determining that the control signal includes the device identifier corresponding to the terminal portion, and for determining output processing to be executed by the processor corresponding to the instruction contents; and an instruction signal output unit for producing the instruction signal including output data for making the processor execute the determined output processing, and for outputting the produced instruction signal to the connecting portion, wherein the processor executes the determined output processing based on the output data included in the instruction signal that is input through the terminal portion.

2. The remote-control toy according to claim 1, wherein the processing determining unit of the signal processing device determines the output processing with respect to a sound corresponding to the instruction contents, and the processor of the unit main body outputs the sound based on sound data as the output data included in the instruction signal.

3. An extension unit that is provided in a remote-control toy, which has a controller for transmitting a control signal containing an operating instruction according to an operation by a user that includes a device identifier, and a driving device for being controlled based on the control signal that corresponds to the device identifier, the extension unit for receiving the control signal, the extension unit comprising:

a unit main body; and a signal processing device detachably connected to an external portion of the unit main body, the unit main body comprising:

a signal receiver for receiving the control signal;

a terminal portion for outputting the received control signal to the signal processing device, the terminal portion corresponding to the device identifier; and a processor for executing output processing based on an instruction signal that is output from the signal processing device, the signal processing device comprising:

a connecting portion that is connected to the terminal portion;

a processing determining unit for discriminating the contents of the operating instruction contained in the control signal that is input through the connecting portion, for determining that the control signal includes the device identifier corresponding to the terminal portion, and for determining output processing to be executed by the processor corresponding to the instruction contents; and an instruction signal output unit for producing the instruction signal including output data for making the processor execute the determined output processing, and for outputting the produced instruction signal to the connecting portion, wherein the processor executes the determined output processing based on the output data included in the instruction signal that is input through the terminal portion.

* * * * *